US005881514A

United States Patent [19]

Pryor

[11] Patent Number: 5,881,514

[45] Date of Patent: Mar. 16, 1999

[54] ROD TIE SYSTEM FOR ENHANCING THE INTERCONNECTION BETWEEN THE WALLS AND ROOF FRAMING SYSTEMS OF TILT-UP BUILDINGS AND THE LIKE

[76] Inventor: John D. Pryor, 4028 39$^{th}$ Ave., Oakland, Calif. 94619

[21] Appl. No.: 866,870

[22] Filed: May 30, 1997

[51] Int. Cl.$^{6}$ ..... E04C 5/08

[52] U.S. Cl. ..... 52/223.8; 52/223.1

[58] Field of Search ..... 52/93.1, 654.1, 52/223.8, 223.11, 223.12, 643, 92.2, 92.1, 223.1

[56] References Cited

U.S. PATENT DOCUMENTS

| | | | |
|---|---|---|---|
| 1,054,175 | 2/1913 | Coffin . | |
| 1,474,660 | 11/1923 | White . | |
| 2,713,983 | 7/1955 | Kay | 248/57 |
| 2,967,726 | 1/1961 | Weston | 287/100 |
| 3,264,021 | 8/1966 | Artman | 287/189.36 |
| 3,850,533 | 11/1974 | Thielen | 403/58 |
| 4,173,857 | 11/1979 | Kosaka | 52/223.8 X |
| 4,188,681 | 2/1980 | Tada et al. | 14/16.1 |
| 4,463,923 | 8/1984 | Reiker | 248/546 |
| 4,518,141 | 5/1985 | Parkin | 248/546 |
| 4,611,948 | 9/1986 | Johnson | 403/232.1 |
| 4,616,950 | 10/1986 | Morris | 403/231 |
| 4,665,672 | 5/1987 | Commins et al. | 52/295 |
| 4,682,452 | 7/1987 | Propp et al. | 52/118 |
| 4,893,961 | 1/1990 | O'Sullivan et al. | 403/232.1 |
| 5,092,096 | 3/1992 | Cornell | 52/702 |
| 5,214,900 | 6/1993 | Folkerts | 52/696 |
| 5,228,261 | 7/1993 | Watkins | 52/702 |
| 5,249,404 | 10/1993 | Leek et al. | 52/702 |
| 5,491,935 | 2/1996 | Coxum | 52/93.1 X |
| 5,561,956 | 10/1996 | Englekirk et al. | 52/223.8 X |
| 5,588,270 | 12/1996 | Keating | 52/223.1 X |

FOREIGN PATENT DOCUMENTS

| | | | |
|---|---|---|---|
| 2063095-A | 9/1993 | Canada | E04G 25/06 |
| 5-272232(A) | 10/1993 | Japan | E04F 15/18 |

*Primary Examiner*—Creighton Smith
*Attorney, Agent, or Firm*—Claude A.S. Hamrick; Oppenheimer W. Donnelly

[57] ABSTRACT

A rod tie system for enhancing the interconnection between the walls and roof framing systems of tilt-up buildings and the like including a first type of connection bracket, a second type connection bracket, a clevis bracket, a turnbuckle bracket, a transfer lug, and several lengths of threaded rod. The first connection bracket and the clevis bracket can be combined to form a single plane articulating bracket, and the second type of connection bracket and the clevis bracket can be combined to form a dual plane articulating bracket. The several lengths of threaded rod are combined with the above brackets, as needed, to form a particular rod tie system. Among the principal advantages of the present invention are that the components thereof can easily be made from readily available stock material using only stamping or shearing devices, drills and welding equipment.

19 Claims, 5 Drawing Sheets

22
16
18
12
20
10

24
26

20
12
18
10

14
16
12
10
22

36
34
38
40
32
30

34
36
40
30

34
44
36
32
30

34
30
32
36
40

32
46
42

52
60
58
56
52
50

58
60
56
52
54
50

56
52
54
50

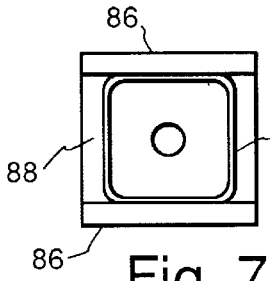
Fig. 7c
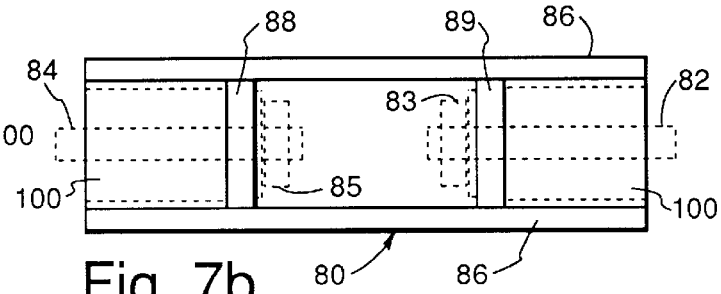
Fig. 7b
Fig. 7a
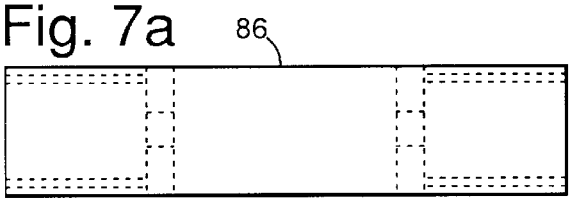
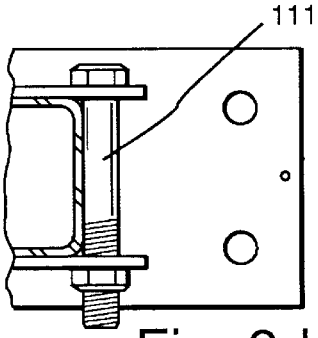
Fig. 8d
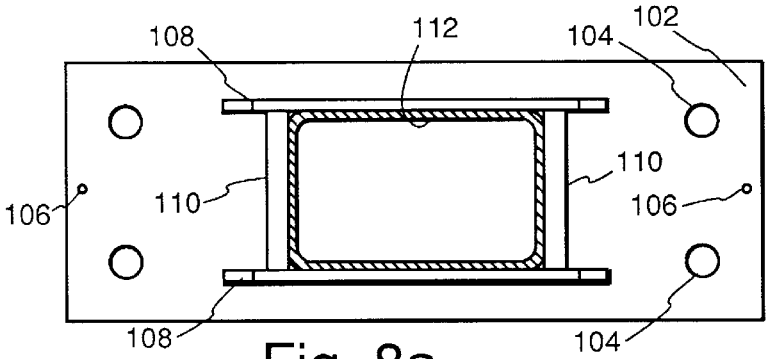
Fig. 8a
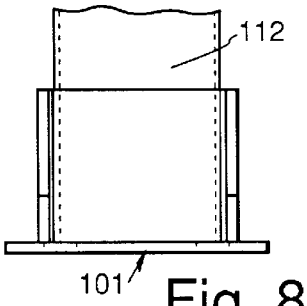
Fig. 8c
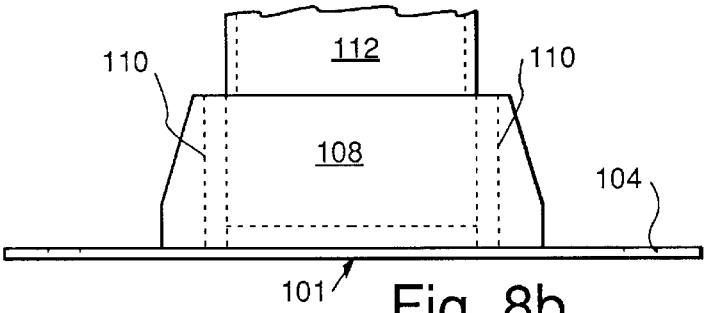
Fig. 8b

ROD TIE SYSTEM FOR ENHANCING THE INTERCONNECTION BETWEEN THE WALLS AND ROOF FRAMING SYSTEMS OF TILT-UP BUILDINGS AND THE LIKE

BACKGROUND OF THE INVENTION

1. Field of the Invention

The present invention relates generally to devices used to interconnect the structural members of a building for the purpose of transferring forces between structural members such as the walls of a building and its roof framing systems, and more particularly to a set of high capacity hardware components that can be used to seismically retrofit existing tilt-up buildings, and the like, having long span timber trusses so as to substantially improve the interconnection between the building walls and roof framing system.

2. Description of the Prior Art

All man-made structures and particularly "tilt-up" buildings of the type frequently used in commercial and industrial environments can be subjected to excess natural and abnormal forces, i.e. seismic wind blast, etc., with disastrous consequences. Investigations have found that such tilt-up buildings especially those with timber roof framing systems, are vulnerable to damage and/or collapse during earthquakes. These types of buildings typically consist of a structure that is constructed with concrete wall panels that are pre-cast horizontally on the ground, and after curing, are tilted into place to form the wall units of a typically rectangular enclosure. Roof framing systems are then affixed to and at least partially supported by the wall panels.

The roof framing systems of older tilt-up buildings that were built between the early 1950's (when the initial construction of tilt-up buildings began) and the mid 1960's were generally constructed with long span timber roof trusses and timber roof joists. The timber trusses of these buildings were normally oriented to span the short direction of the building with spacing between the trusses generally varying between 16 and 24 feet. The roof joists generally consist of 2×8's, 2×10's or 2×12's spaced at 24 inches o.c. and span between the timber trusses. At the perimeter of the building the roof joists span between the timber trusses and the tilt-up wall panels, where they are usually framed onto a timber ledger that is bolted to the wall panels. Roof sheathing for these buildings is normally comprised of ⅜ inch or ½ inch plywood.

After the mid 1960's the roof framing systems of most tilt-up buildings were constructed with glulam beams instead of long span timber trusses and a "panelized" roof framing system instead of roof joists. These modifications to the roof framing systems were typically made for economic reasons. A panelized roof framing system consists of timber purlins, timber sub-purlins (also known as stiffeners) and roof sheathing. The roof sheathing normally consists of 4×8 sheets of ⅜ inch or ½ inch plywood and spans between the sub-purlins. The sub-purlins are generally 2×4's or 2×8's and span between the purlins. The purlins typically consist of 4×12's or 4×14's and span between the glulam beams (or in some cases long span timber trusses). The plywood sheathing is usually oriented with its long dimension parallel to the sub-purlins or perpendicular to the purlins. The sub-purlins are generally spaced 24 inches apart. The purlins are typically 8 feet apart to accommodate the length of the plywood sheathing. The glulam beams are often spaced 20 to 24 feet apart and sections of the panelized roof are typically fabricated on the ground and raised into place with a crane or a forklift.

In areas subject to high seismicity, the connection between the concrete wall panels of most older tilt-up buildings and their roof framing systems is inadequate for the currently established seismic design standards for such buildings. Generally this connection consists of only the nailing between the roof sheathing and the timber ledger that is bolted to the wall panel, and relies on a mechanism that subjects the ledgers to "cross-grain bending", a mechanism that is highly vulnerable to failure. The deficiency associated with this type of connection was responsible for numerous failures and collapses of tilt-up buildings during the 1971 San Fernando earthquake. As a result, this type of connection has been specifically disallowed since the 1973 edition of the Uniform Building Code was published. It is generally recommended that tilt-up buildings with such deficiencies be retrofitted with new connections per the currently established seismic design standards and/or recommendations for such buildings. For tilt-up buildings with long span timber roof trusses there has not been a uniform method of installing retrofit structural elements for the purpose of connecting the wall panels to their roof framing system.

One of the connection problems often encountered is improperly dealing with the steep and varying angles present between the roof framing system and the wall panels (such problems being generally not encountered in tilt-up buildings with glulam beams and panelized roof framing systems). At the present time, the retrofit installation of these connections is usually undertaken with "hold-down" connection devices and/or custom fabricated hardware components that incorporate currently available structural components such as rods, devices and turnbuckles.

"Hold-down" connection devices were initially developed to provide a means of attaching the studs at the ends of plywood shearwalls to foundations or other studs, but have been adapted for various other uses. In tilt-up buildings with long span timber roof trusses, hold-downs are sometimes used to attach the wall panels to the roof joists. Due to the slope of the roof joists in these buildings such attachments are usually difficult to install and do not properly resolve both the horizontal and vertical force components associated with the attachment.

Hold-down connection devices are generally designed for overall load capacity without regard to overall device deflection. Such connection devices are subject to excessive deflections when loaded. Recent studies of earthquake damage to buildings have recommended that the device deflection of connection devices used in wall attachments be limited in order to prevent the forces associated with these attachments from effectively being transferred through the plywood roof sheathing, and thereby subjecting the timber ledgers to cross-grain bending. Some building departments have taken these recommendations into account and have established their own device deflection criteria. One such criteria put forth by the city of Los Angeles has reduced the allowable capacity of hold-down devices in general by a factor of 3 to 5. Such criteria increases the size, number and costs associated with hold-down connection devices. Another deficiency of the hold-down connection device is that the bolt holes bored through the wood members are prone to being oversized, especially in paired applications where access is impaired. Connection devices installed with such bolt holes must undergo an additional amount of deflection before the "slop" between the bolt and the wood is taken up. Such deflections affect the structural performance in a building in a manner similar to the deflections associated with a hold-down connection device.

Custom fabricated hardware components that incorporate elements such as rods, devices and turnbuckles are subject to a number of drawbacks, problems and deficiencies. In general, these components must usually be designed by an engineer and be fabricated on a limited basis, and thus take time to procure, and are expensive. Furthermore, devices and turnbuckles are usually cast items and are subject to brittle failure. The current seismic design philosophy is to avoid the use of any hardware element, component or mechanism that is subject to brittle failure. The allowable load capacity of clevices and turnbuckles is thus low, and in many cases is lower than that of the rod. Thus, these elements usually establish the allowable load capacity of the hardware component or connection. Moreover devices and turnbuckles are not necessarily "readily available" (particularly clevices) and can be difficult to procure. In fact, devices and turnbuckles can be quite expensive, especially when their allowable load capacity is considered. For rod tightening purposes, turnbuckles are usually provided with right-hand (standard) threads at one end and left-hand (reversed) threads at the other. This generally requires that a special length of rod be provided with right-hand threads at one end and left-hand threads at the other. These special lengths of rod can be difficult to procure, are expensive and add an additional element of complexity to the hardware component or connection.

SUMMARY OF THE INVENTION

It is, therefore, a principal objective of the present invention to provide an improved system of high capacity, structural hardware components that can be used to seismically retrofit tilt-up buildings.

Another object of the present invention is to provide a system of the type described, including a plurality of individual components that can be combined in various ways with standard threaded rod or all-thread rod elements to provide discreet structural connections between various elements of a building or structure.

Another objective of the present invention is to provide improved hardware components made from sheet steel or steel plate and including no cast sub-components that might precipitate a brittle failure.

Briefly, a preferred embodiment of the present invention includes a first type of connection bracket, a second type connection bracket, a clevis bracket, a turnbuckle bracket, a transfer lug, and several lengths of threaded rod. The first connection bracket and the clevis bracket can be combined to form a single plane articulating bracket, and the second type of connection bracket and the clevis bracket can be combined to form a dual plane articulating bracket. The several lengths of threaded rod are combined with the above brackets, as needed, to form a particular rod tie system. Among the principal advantages of the present invention are that the components thereof can easily be made from readily available stock material using only stamping or shearing devices, drills and welding equipment.

Another advantage of the present invention is that the various components can be mixed and matched as needed to accommodate a particular structure to be retrofit.

Yet another advantage of the present invention is that readily available right-hand threaded rod stock can be used with no left-hand threads being required.

Another advantage of the present invention is that the component parts thereof are designed to minimize device deflection.

Still another advantage of the present invention is it is adjustable and adaptable, and installation of the various components does not require that the holes bored through the timber framing elements be drilled accurately—as is required for paired holddown-type connector systems.

These and other objects and advantages of the present invention will no doubt become apparent to those skilled in the art after having read the following detailed disclosure of a preferred embodiment which is illustrated in the several figures of the drawing.

IN THE DRAWING

FIGS. 1*a*–1*c* are respectively side, top and front views of a connection bracket, and FIG. 1*d* is a pin bolt and nut used in association therewith.

FIGS. 2*a*–2*e* are various views showing a rotatable connecting bracket and its associated base plate.

FIGS. 3*a*–3*c* are respectively side, top and end view of a clevis bracket in accordance with the present invention.

FIGS. 4*a* and 4*b* are respectively side and top views of an assembly of the components of FIGS. 1 and 3 forming a single plane articulating bracket in accordance with the present inventions.

FIGS. 5*a* and 5*b* are respectively side and top views illustrating a combination of the components of FIGS. 2 and 3 joined to form a dual plane articulating bracket in accordance with the present inventions.

FIGS. 6*a* and 6*b* are respectively side and top views showing an alternative embodiment of a single plane articulating bracket made using bent sheet metal or steel plate stock.

FIGS. 7*a*–7*c* are respectively side, top and end views illustrating a turnbuckle in accordance with the present invention.

FIGS. 8*a*–8*d* are respectively a cross-sectional view, a partial top view, a partial side view and a partial top view of an alternative transfer lug assembly in accordance with the present invention.

FIG. 9 is a top plan view showing one corner of a building structure depicting various roof framing elements supporting beams and the manner of interconnect in accordance with the present invention.

FIGS. 10*a* and 10*b* are respectively elevational and plan views illustrating tie connection details utilizing the connection system of the present invention.

FIG. 11 is a partial elevational view taken along the line 11—11 in FIG. 10*b*, and showing the top of a sloped roof truss with the rotatable connection bracket of a dual plane articulating bracket in accordance with the present invention affixed equidistant between two adjacent roofjoists.

DETAILED DESCRIPTION OF PREFERRED EMBODIMENTS

Figures 1A, 1B, 1C, 1D, 2A, 2B, 2C, 2D, 2E, 3A, 3B, 3C:
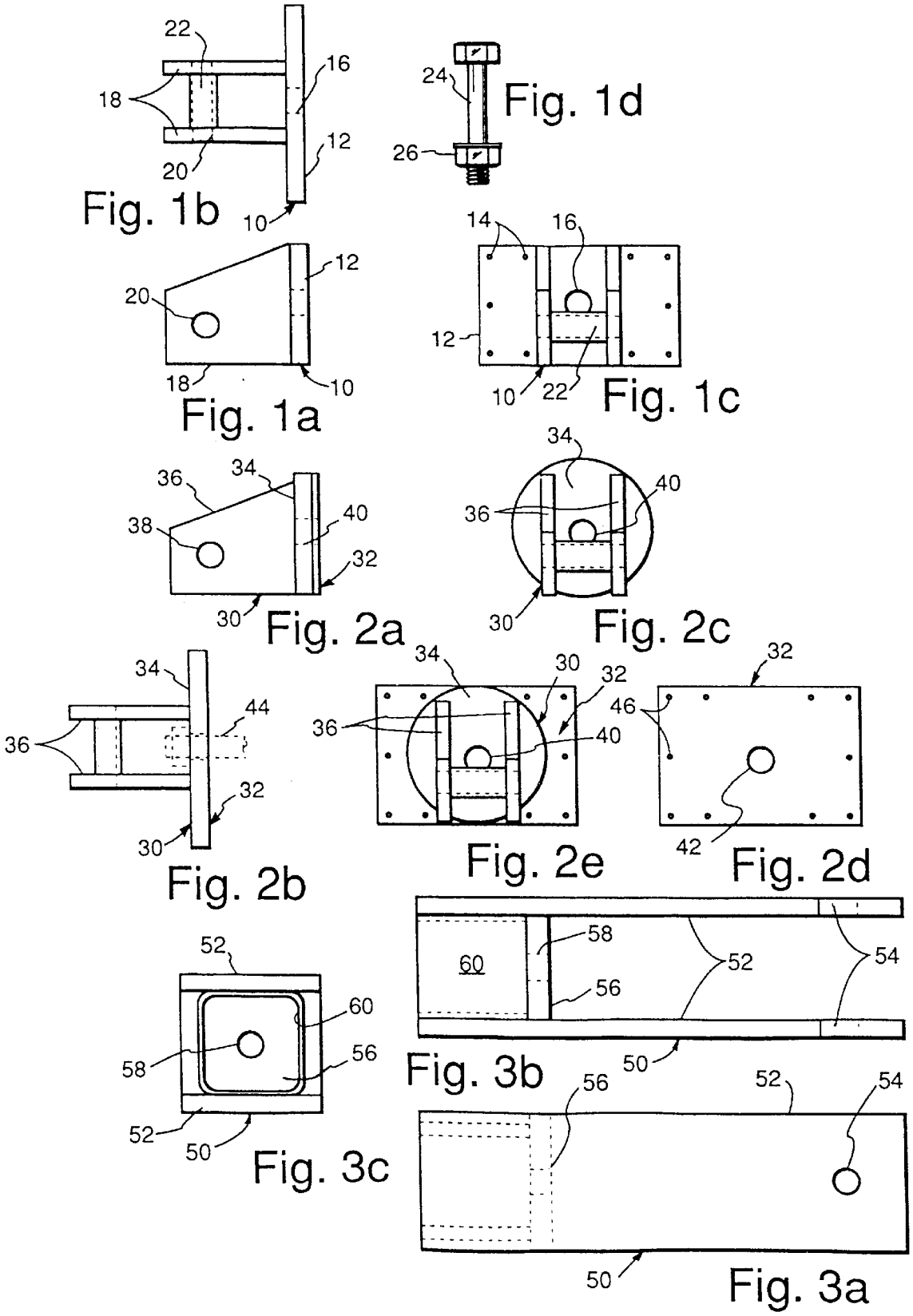

Referring now to FIGS. 1*a*–1*c*, which are respectively side, top and end views of a connection bracket, in accordance with the present invention, and shown at 10. includes a flat base plate 12 that is rectangular in configuration and has a plurality of holes 14 provided in side portions thereof for receiving nails, screws or other fasteners, and a central aperture 16 for receiving a bolt or rod. Welded to the front face of base plate 12 are a pair of tab plates 18 having bolt holes 20 formed therein. Disposed between tab plates 18 and positioned concentric with bolt holes 20 is a pipe sleeve 22 that may or may not be tack welded to the tab plates 18.

In FIG. 1*d* a pin bolt 24 and locking nut 26 are depicted. Bolt 24 is adapted for passage through openings 20 and sleeve 22 for purposes which will be described below.

Turning now to FIGS. 2*a*–2*e* a rotatable connection bracket assembly including a bracket 30 and associated fastener plate 32 is depicted. Bracket 30 is similar to the bracket 10 of FIG. 1 in that it includes a base plate 34 having a pair of tab plates 36 welded thereto with each plate 36 including a bolt hole 38. Base plate 34 is likewise similar to the base plate 12 of FIG. 1 in that it includes a central aperture 40 for receiving a bolt or rod but differs therefrom in that its outer perimeter is round. It will, of course, be appreciated that the perimeter of base plate 34 could also be of any other adjustable shape, but round is preferred for most applications. Fastener plate 32 is a rectangular piece of sheet metal or steel plate having a centrally positioned circular aperture 42 formed therein for receiving a bolt or rod as suggested by the 44 in FIG. 2*b* plate 32 further includes a plurality of fastener holes 46 passing there through. As will be further described below the back surface of bracket base 34 is intended to bear against fastener plate 32 and be held in engagement therewith by the bolt or rod 44. However, as will also be further described below, bracket 30 is intended to be rotatable relative to plate 32 about the axis of bolt or rod 44.

In FIGS. 3*a*–3*c* a clevis bracket in accordance with the present invention is depicted at 50 and is comprised of a pair of side plates 52 having pin bolt receiving apertures 54 formed at one end thereof for receiving a pin bolt. Between and at one of end of the side plates 52 is a short segment of rectangular tube stock 60 welded to side plates 52. A rigid rectangular bearing plate 56 with a central aperture 58 formed therein to receive a rod is located between side plate and tack welded to one end of tube stock 60.

The clevis bracket functions similar to that of a standard cast clevis in that it allows single plane articulation of a rod connection attached to either the single plane articulating bracket or the dual plane articulating bracket. Rod stock can be tightened at the clevis bracket by rotating a nut at the rod end. This element eliminates the need for standard cast turnbuckles in order to tighten up the rod. Load capacity is significantly greater than that of standard cast devises and the assembly is not subject to brittle failure. The clevis bracket merely consists of one bearing plate, one tube steel element and two side plates. The bearing plate is attached to the tube steel element with non-structural tack welds. The tube steel element is attached to the side plates with four structural welds oriented parallel to the rod and running the length of the tube steel element. The side plates of the clevis bracket are provided with bolt holes at the end opposite to which the bearing plate and the tube steel element are attached, to facilitate attachment thereto to a connection bracket (either single plane or dual plane). Design allows for multiple rod sizes to be used for each general clevis bracket by simply altering the size of the hole provided in the bearing plate.

Figure 4B:
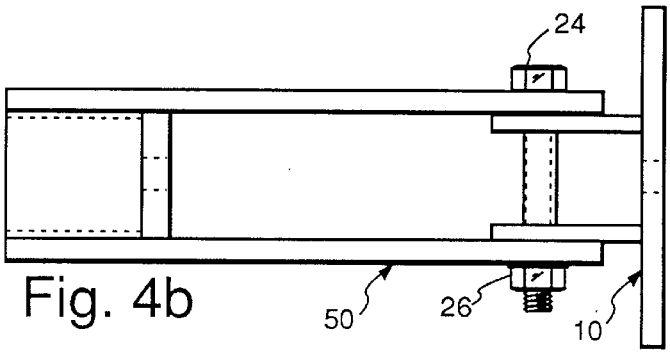
Figure 4A:
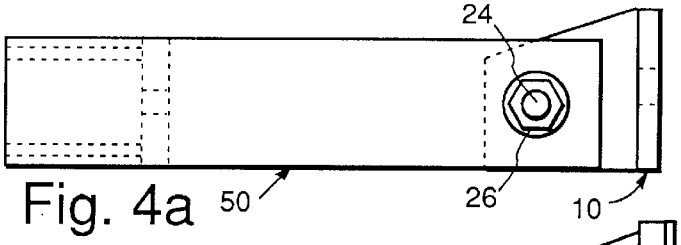

Turning now to FIGS. 4*a* and 4*b* a single plane articulating bracket formed of a connecting bracket 10 as depicted in FIGS. 1*a*–1*c*, and a clevis bracket 50, as depicted in FIGS. 3*a*–3*c* are held together by a pin bolt 24 and nut 26 (FIG. 1*d*). As will be appreciated, with bracket 10 secured to a beam or wall (not shown), clevis bracket 50 will be rotatable about pin 24 in a plane normal to the axis of pin 24.

The single plane articulating bracket provides a single plane articulating connection. It may be attached to a timber ledger, a concrete wall panel, or timber framing element, and allows for both the horizontal and vertical force components to be resolved. The articulating bracket consists of one rectangular base plate, two tab plates, one pipe spacer element and one pin bolt. Articulation occurs at the pin bolt that attaches the clevis bracket to a connector. The base plate is provided with at least one bolt hole located at the center thereof. Additional bolt holes may be provided as required, and are usually located outside of the tab plates. The base plate is typically provided with fastener holes to allow attachment to ledgers and timber framing elements. The fasteners are used to resist the force component, transverse to the run of the rod at connections in which the rod changes direction. The tab plates are attached to the base plate with structural welds. These plates are provided with bolt holes to allow for the attachment of the connecting bracket to the clevis bracket with a pin bolt. These bolt holes are generally offset from the center hole of the base plate. This is done so that when the clevis bracket is oriented at an incline to a connecting bracket (as is typical), the line of force will generally coincide closely with the center hole in the base plate, and thus minimize the eccentricity that must be resolved through the assembly. The tubular spacer element is located between the bolt holes of both tab plates and is equal in length to the distance between the tab plates. Its purpose is to keep the side plates of the clevis bracket and the tab plates of the articulating bracket assemblies from being over-compressed when the pin bolt is tightened. The spacer element may be attached to the articulating bracket with a non-structural tack weld. This is done to insure that the spacer element is provided with the articulating bracket.

It should be noted that at least one edge of both tab plates, and sometimes both edges, are cut at an angle. The angles formed by the top and bottom edges of the tab plates are generally taken to be the general maximum and minimum angles that the clevis bracket may be inclined relative to the connector bracket without exceeding the capacity of the connection. This is done so that it can be quickly determined upon visual inspection whether or not the inclination angle of the connecting bracket is within the inclination parameters. The allowable inclination of the clevis bracket assembly usually varies between a slope of 0:12 (horizontal) at a minimum to 6:12 as a maximum. Inclinations exceeding these parameters may be allowed upon a more detailed analysis of the connection and/or modification of the connection brackets.

Figure 5A:
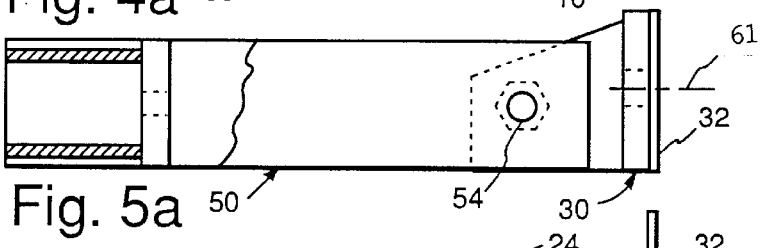
Figure 5B:
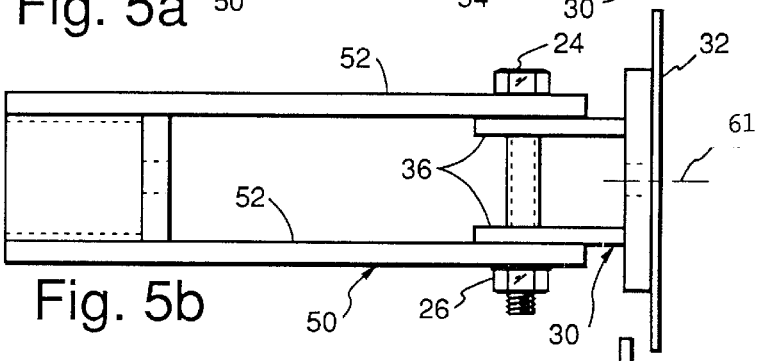

In FIGS. 5*a* and 5*b*, which are respectively side and top views, a dual plane articulating bracket is shown including a clevis bracket 50 and a rotatable connection bracket 30 of the type depicted in FIGS. 2*a*–2*e*, including its associated fastener plate 32 as shown in FIG. 2*d*. As particularly illustrated in FIG. 5*b* it will be noted that the side plates 52 extend outside of the tab plates 36 and are rotatively secured thereto by a pin bolt 24 passed through the openings 54 and held in place by a nut 26. As will be understood from further description below, with fastener plate 32 affixed to a wall or beam (not shown), the bracket 30 may be rotated about a rod axis 61, and clevis 50 may be rotated about the axis of pin bolt 24; hence, the name "dual plane articulating bracket".

Figure 6B:
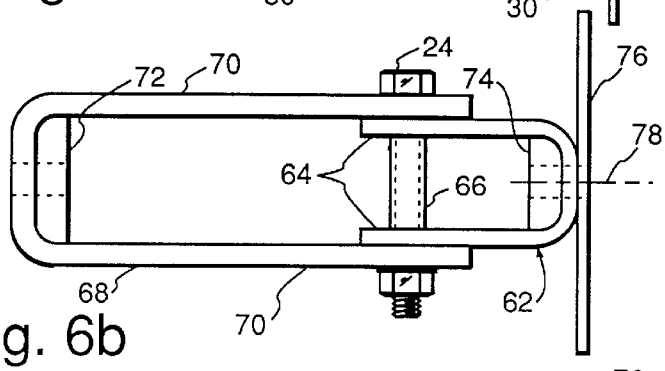
Figure 6A:
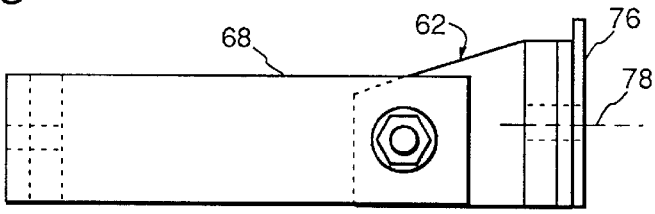

In FIGS. 6*a* and 6*b* a functionally different structure to that of FIGS. 5*a* and 5*b* is depicted wherein the principal difference is that the connecting bracket 62 is formed of a piece of sheet metal or steel plate formed around an anvil such that distal ends thereof form tab plates 64 with apertures, to receive a pin bolt 24 passed both through the apertures and a sleeve 66, located therebetween. A clevis bracket 68 is similarly formed from an elongated strip of sheet metal or steel plate such that its distal ends form side plates 70, likewise apertured to receive pin bolt 24. In order to add-rigidity to the bases of both connection bracket 62 and clevis device 68, apertured washer plates 72 and 74 are positioned at the base of bracket of 62 and at the distal end of clevis 68. As in the embodiment of FIGS. 5*a*–5*b*, an associated fastener plate 74 is provided against which the connector bracket 62 may bear and rotate about the axis 78 of a bolt or rod stock extended therethrough.

Although the brackets 10 (FIG. 4*a*), 30 (FIG. 5*a*) and 62 (FIG. 6*a*) are fabricated such that the tab plates thereof are positioned inside of the clevis side plates, it is to be understood that the clevis side plates could be positioned between the bracket tab plates, in which case the pin bolt receiving sleeve would be positioned between the clevis side plates.

FIGS. 7*a*–7*c* depict side, top and end views respectively of a turnbuckle bracket 80 adapted to receive ends of a pair of threaded rods 82 and 84, as depicted by dashed lines in FIG. 7*b*. The turnbuckle assembly includes a pair of rectangular side plates 86. At each end of the side plates 86 and disposed therebetween is a short segment of rectangular tubular stock 100 attached to the adjacent side plates 86. Bearing plates 88 and 89, apertured to receive rods 82 and 84, are located at opposite ends of the turnbuckle bracket between side plate 86 and are attached to the rectangular tube stock elements 100. As will be understood by those skilled in the art, the rotation of nuts 83 and 85 on threaded rods 82 and 84, respectively will apply tension to the rod line in the same manner that a standard turnbuckle will apply tension; however, no left-hand threads are required.

Figure 10B:
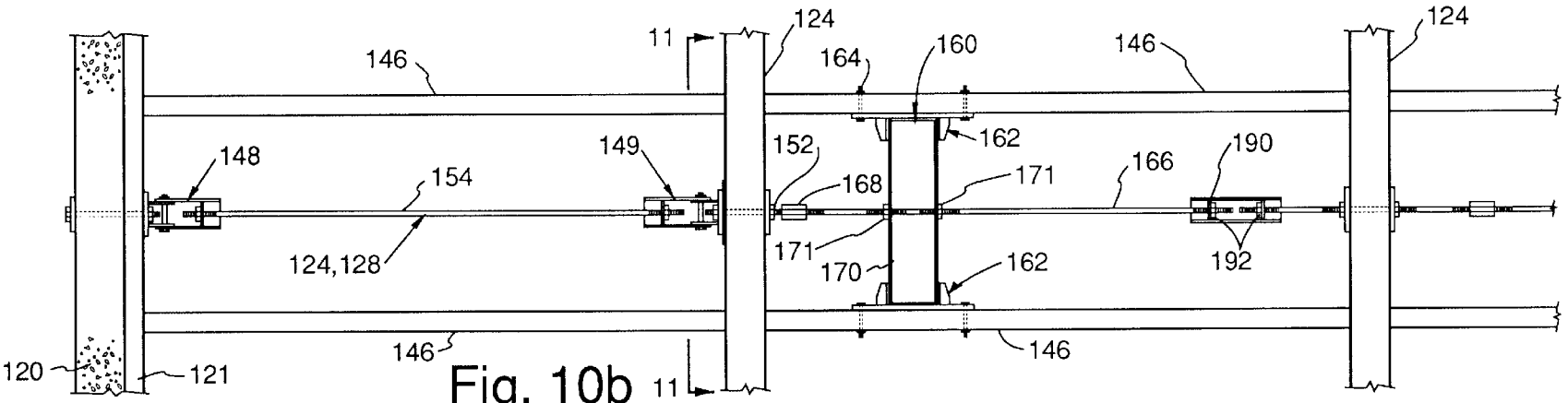
Figure 10A:
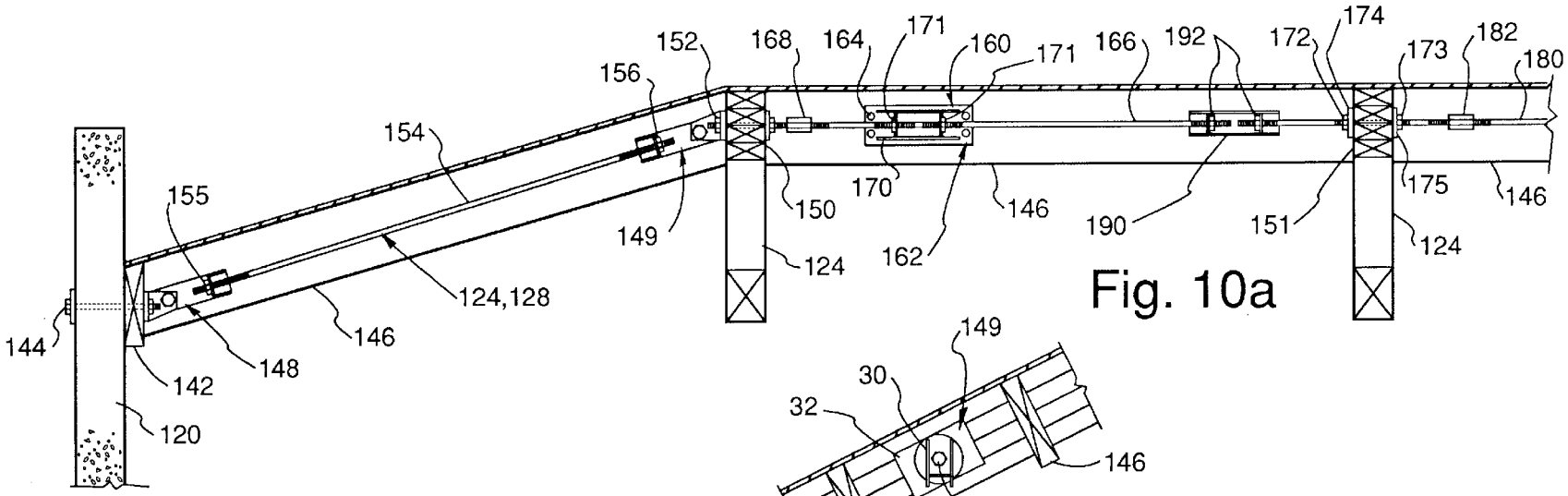

Referring to FIGS. 8*a*–8*d* a transfer lug assembly in accordance with the present invention will be described. In these figures only one of two base plate assemblies 101 and a partial length of rectangular tubular stock is illustrated. The complete assembly is depicted in FIGS. 10*a* and 10*b*. As shown the assembly 101 includes a base plate 102 having a plurality of fastener apertures 104 provided near each corner thereof, and fastener apertures 106 centrally located at opposite extremities thereof. Welded to base plate 102 are a pair of side plates 108 and a pair of bearing plates 110. The combination of bearing plates and side plates forms a rectangular pocket for receiving one end of a cross member in the form of a tubular element 112. Although not depicted herein, but as will be described further herein below, the tubular element 112 is provided with a central aperture through which a rod may be passed and secured to the element 112 by one or more nuts (not shown).

The transfer lug allows for the transfer of forces between the rod and roof joists (either from the rod to the joists or from the joists to the rod). The transfer lug is used when the capacity of the top chord of the existing timber roof truss is inadequate as a mechanism to provide direct attachment between the rod and the roof framing system, or when the overall elongation of the rod when loaded is to be minimized (such as may be necessary at those attachments between the wall panels of a building and its roof framing system). As depicted in FIGS. 8*a* and 8*b*, a threaded rod may be attached to the tube steel element 112. The element 112 spans between the end brackets 101, which are attached to adjacent roof joists. The tubular element 112 is not directly attached to the end brackets 101, and the load transfer between the elements, 112 and the end brackets 101 is made by a simple bearing force applied against a bearing plate 110. This allows the tubular element to be cut somewhat short to allow for any variations in dimension between the roof joist, and thus expedites installation of the transfer lug. The end brackets 101 are attached to the roofjoist with a plurality of fasteners (not shown).

The turnbuckle bracket 80 provides a function similar to that of a standard cast turnbuckle (i.e., it allows for mid-length tightening of a rod). Reverse (left-hand) threaded rod is not required. Moreover, load capacity is significantly greater than that of standard cast turnbuckles, and since the bracket assembly is not made of cast materials, it is not subject to brittle failure. As indicated above, the turnbuckle bracket consists of two bearing plates, two tube steel elements and two side plates. The bearing plates are attached to the tube steel elements with non-structural tack welds. The tube steel elements are attached to the side plates with four structural welds, oriented parallel to the rod and running the length of the tube steel elements. Design allows for multiple rod sizes to be used for each general turnbuckle bracket by simply altering the size of the hole provided in the bearing plate.

Figure 9:
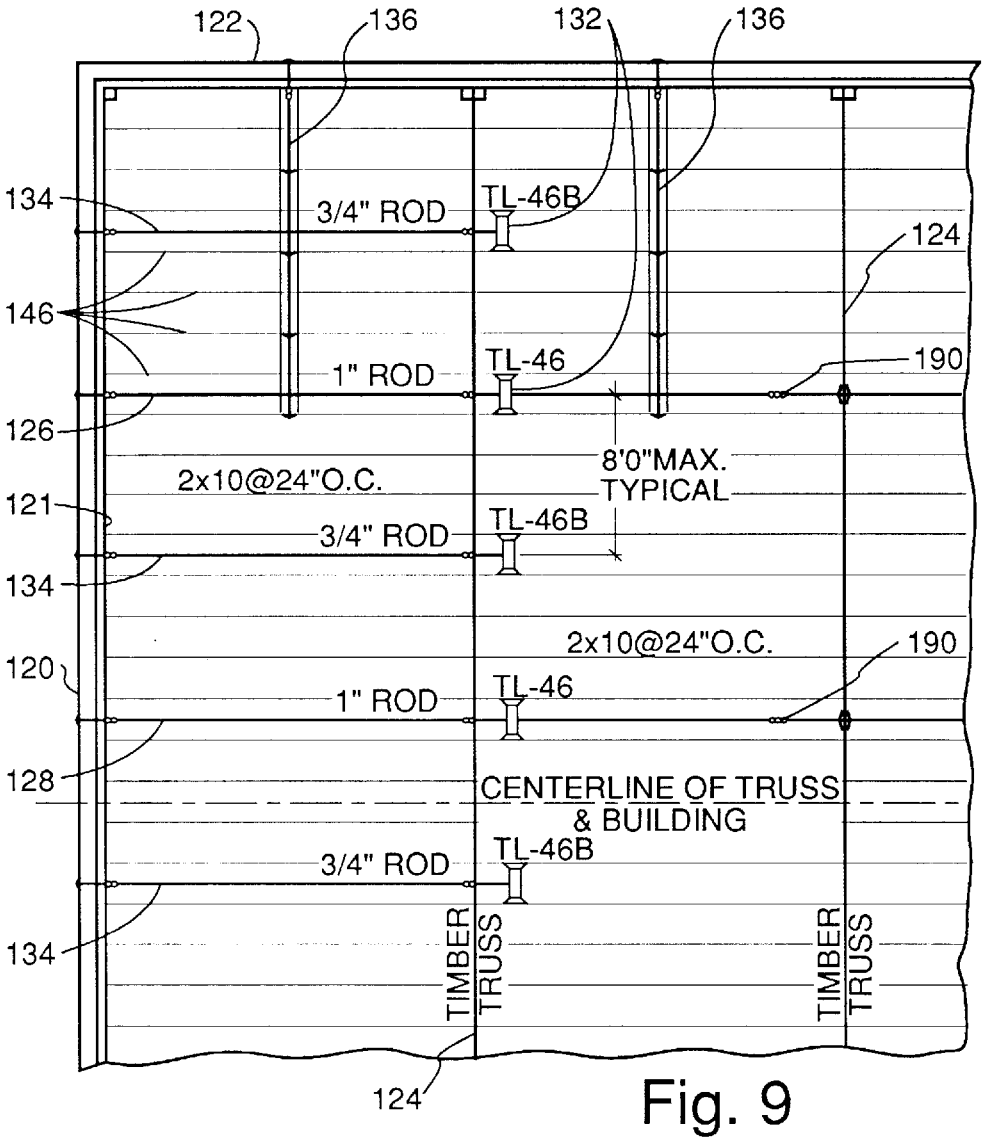

Referring to FIG. 9 which is a partial plan view showing one comer of a building comprised of tilt-up wall panels (or concrete block walls) with end walls 120 and side walls 122 having ledgers 121 affixed thereto. The roof layout includes a plurality of timber trusses 124 spanning the width of the building and joists 146 spaced at two foot intervals spanning from truss to truss, or wall to truss.

In order to seismically interconnect the walls and roof framing system, a plurality of rod ties, some continuous and some discontinuous are utilized. For example, continuous rod ties are depicted at 126 and 128 and discontinuous rod ties terminating interiorally at transfer lugs 132 are depicted at 134. Discontinuous rod ties spanning from wall to a crossing rafter are illustrated at 136.

FIGS. 10*a* and 10*b*, which are respectively elevational and plan views, depict in part one tie line. As shown in FIG. 10*a* a tilt-up wall 120 has a ledger 121 attached thereto, typically through the use of bolts (not shown). Roof joists 146 span between the truss 124 and wall 120 as indicated, and between the adjacent trusses 146. In retrofitting a rod tie system in accordance with the present invention to a roof framing system such as that depicted, a single plane articulating bracket assembly such as that depicted in FIGS. 4*a* and 4*b* would be attached to ledger 121 by means of a bolt 144 as indicated at 148 and a dual plane articulating bracket 149 would be attached to the upper cord 150 of truss 124 by a bolt (or rod) 152. The bracket assemblies 148 and 149 would then be interconnected by means of a threaded rod 154 and drawn tight by means of nuts 155 and 156. In order to transfer the lateral tie load from the rod to the roof joists between the first and second trusses 124, a transfer lug assembly 160 is utilized wherein the base plate sub-assemblies 162 are affixed to joists 146 on opposite sides of the rod tie line by means of fasteners (bolts) 164, and a threaded tying rod 166 is coupled to the bolt 152 by a coupler 168 passed through the tubular element 170 of transfer lug 160 and through the upper cord 151 of the second truss 124. Nuts 171 secure rod 166 to lug cross-element 170. Nuts 172 and 173, together with washer plates 174 and 175, secure rod 166 to truss cord 151. A continuing rod 180 is connected to rod 166 by means of a coupler nut 182, and continues across the roof diaphragm to join the opposite wall via a similar combination of transfer lug and single and dual plane articulating bracket assemblies. Note that the transfer lug can be used in any rod run and at any desire place along the run. It may also be used to terminate one end of a rod run. Note also that this transfer lug may be eliminated when the top chord of the roof truss (or similar structural framing element) has sufficient structural capacity to provide a load transfer mechanism similar to that of a transfer lug.

In order to tighten up the rods along a particular tie line or rod run such as that illustrated, one or more turnbuckles 190 may be installed at any suitable locations along the line. To tighten the line, one or both of the nuts 192 would be rotated to advance along the threaded rods 166. As pointed out above, an important advantage of using the above described turnbuckle design is that no left-hand threads are required, and as a consequence, a workman will always know that a clockwise rotation of a nut 192 (as viewed from the rod end) will result in a tightening of the line.

Figure 11:
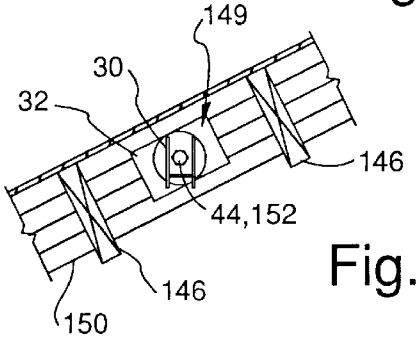

FIG. 11 is a partial elevational view taken along the lines 11—11 in FIG. 10*b* and shows an end view of the rotatable connection bracket (of the type shown in FIG. 2*a*) of the dual plane articulating bracket 149 as it may be attached to the inclined top chord 150 of the first truss 124 between two adjacent joists 146. This view illustrates how the fastener plates is aligned with and attached to the top chord 150 of truss 124 (FIG. 10*a*, 10*b*) while connection bracket 30 is allowed to rotate about bolt or rod 44 (152 in FIGS. 10*a* and 10*b*) so as to permit the dual plane articulating bracket 149 to be properly aligned with the single plane articulating bracket 148 attached to ledger 121 at wall 120 (FIGS. 10*a*, 10*b*).

It should be noted that the dual plane articulating bracket may have to be used at the ledger due to a combination of shallow ledger depth and excessive ledger inclination (to the horizontal) that prevents the installation of a single plane articulating bracket, or when the wall is skewed and not oriented perpendicular to the run of the roof joist framing. The overall system is also applicable to many other building types other than this building type (tilt-up building with timber roof trusses and joists) for which it was primarily intended.

Although the present invention is described above in terms of preferred embodiment, it is contemplated that after having read this disclosure various alterations and modifications thereof will become apparent to those skilled in the art. It is, therefore, intended that the appended claims be interpreted broadly to cover all such alterations and modifications as fall within the true spirit and scope of the invention.

What is claimed is:

1. A rod tie system for enhancing an interconnection between walls and a roof framing system of a tilt-up building wherein the roof framing system includes at least one roof support member such as a truss, roof beam, or girder supporting a plurality of joists at least some of which extend from a wall to the support member, the joists having sheathing fastened to top surfaces thereof to form a roof, comprising:

one or more lengths of rods forming a rod line;

means forming a first articulating bracket articulatable in at least one plane and adapted for use in attaching one end of said rod line to a first wall; and means forming a transfer lug including a first end bracket for attachment to one of the roof forming joists, a second end bracket for attachment to an adjacent roof forming joist, and an elongated cross-member engaging and spanning between said first and second end brackets, said cross-member including means for connection to said rod line, said transfer lug being operative to transfer forces applied along said rod line to the roof framing system.

2. A rod tie system as recited in claim 1 wherein said first articulating bracket means includes a connector bracket for attachment to the first wall and a first pivot pin; and first clevis means having one end pivotally attached to said first pivot pin and an opposite end attached to a first rod having an end forming said one end of said rod line.

3. A rod tie system as recited in claim 2 and further comprising:

means forming a second articulating bracket articulatable in one plane and rotatable in another plane, and adapted for use in attaching said rod line to a portion of a support member extending at an angle other than normal to said first wall, said second articulating bracket including a rotatable bracket attached to and rotatable relative to a portion of said rod line extending through said support member and having a second pivot pin, and a second clevis means having one end pivotably attached to said second bracket by said second pivot pin and another end attached to said first rod.

4. A rod tie system as recited in claim 3 and further comprising:

turnbuckle means tightening said rod line and including first bearing plate means forming a first bearing surface having an aperture therein receiving a first threaded end of a rod included in said rod line end and having a first nut threading on said first threaded end to bear against first bearing surface, second bearing plate means forming a second bearing surface having an aperture therein receiving a second threaded end of another rod included in said rod line and including a second nut threading onto said second threaded end to bear against said second bearing surface, and means rigidly joining said first and second bearing plate means, whereby tightening of said nuts tightens said rod line.

5. A rod tie system as recited in claim 3 and further comprising means forming a third articulating bracket articulatable in at least one plane and adapted for use in attaching an end opposite said one end of said rod line to a second wall opposite said first wall.

6. A rod tie system as recited in claim 5 and further comprising:

turn buckle means tightening said rod line and including first bearing plate means forming a first bearing surface having an aperture therein receiving a first threaded of a rod included in said rod line end and having a first nut threading on said first threaded end to bear against said first bearing surface, second bearing plate means forming a second bearing surface having an aperture therein receiving a second threaded end of another rod included in said rod line and including a second nut threading onto said second threaded end to bear against said second bearing surface, and means rigidly joining said first and second bearing plate means, whereby tightening of said nuts tightens said rod line.

7. A rod tie system as recited in claim 1 and further comprising:

means forming a second articulating bracket articulatable in at least two planes and adapted for use in attaching said rod line to a portion of a support member extending at an angle other than normal to said first wall, said second articulating bracket including a rotatable bracket attached to and rotatable relative to a portion of said rod line extending through said support member and having a pivot pin, and a clevis means having one end pivotably attached to said second bracket by said pivot pin and another end attached to a first rod having an end forming said one end of said rod line.

8. A rod tie system as recited in claim 1 and further comprising means forming a second articulating bracket articulatable in at least one plane and adapted for use in attaching an end opposite said one end of said rod line to a second wall opposite said first wall.

9. A rod tie system as recited in claim 2 wherein said connector bracket includes a base with tab plates extending outwardly therefrom, said tab plates having apertures therein receiving said first pivot pin, said tab plates having at least one edge intersecting said base at a predetermined angle as a visual reference for determining whether or not the first clevis means and the attached rod line intersect the connector bracket at an angle within allowable inclination tolerances.

10. A rod tie system as recited in claim 3 wherein said rotatable bracket includes a base with tab plates extending outwardly therefrom, said tab plates having apertures therein receiving said second pivot pin, said tab plates having at least one edge intersecting said base at a predetermined angle as a visual reference for determining whether or not the second clevis means and the attached rod line intersect the connector bracket at an angle within allowable inclination tolerances.

11. A rod tie system as recited in claim 1 wherein said first articulating bracket includes:

a rotatable bracket means for attachment to said first wall and having a first pivot pin; and a clevis means having one end pivotably attached to said rotatable bracket means by said first pivot pin, and another end attached to said one end of said rod line.

12. A rod tie system as recited in claim 11 and further comprising means forming a second articulating bracket articulatable in at least one plane and adapted for use in attaching said rod line to a portion of said support member extending at an angle other than normal to said first wall.

13. A rod tie system as recited in claim 3 and further comprising a fastener plate for attachment to said support member, said rotatable bracket being rotatably connected to said fastener plate and adapted to bear thereagainst.

14. A rod tie system for enhancing the interconnection between walls and roof framing system of a tilt-up building wherein the roof framing system includes at least one support member for supporting a plurality of joists at least some of which extend from a wall to the support member, the joists having sheathing fastened to the tops thereof to form a roof, comprising:

one or more lengths of rods forming a rod line;

means forming a first articulating bracket articulatable in at least one plane and adapted for use in attaching one end of said rod line to a first wall; and means forming a second articulating bracket articulatable in at least one plane and rotatable in another plane, and adapted for use in attaching said rod line to a portion of a support member extending at an angle other than normal to said first wall; said second articulating bracket including a rotatable bracket attached to and rotatable relative to a portion of said rod line extending through said support member and having a second pivot pin, and a second clevis means having one end pivotably attached to said second bracket by said second pivot pin and another end attached to said first rod.

15. A rod tie system as recited in claim 9 and further comprising:

means forming a transfer lug including a first end bracket for attachment to one of the roof forming joists, a second end bracket for attachment to an adjacent roof forming joist, and an elongated cross-member engaging and spanning between said first and second end brackets, said cross-member including means for connection to said rod line, said transfer lug being operative to transfer forces applied along said rod line to the roof framing system.

16. A rod tie system as recited in claim 9 wherein said first articulating bracket means includes a connector bracket for attachment to said first wall and a first pivot pin; and first clevis means having one end adapted for pivotal attachment to said first pivot pin and an opposite end attached to a first rod having an end forming said one end of said rod line.

17. A rod tie system as recited in claim 11 and further comprising:

turnbuckle means tightening said rod line and including first bearing plate means forming a first bearing surface having an aperture therein receiving a first threaded end of a rod included in said rod line end and having a first nut threading on said first threaded end to bear against said first bearing surface, second bearing plate means forming a second bearing surface having an aperture therein receiving a second threaded end of another rod included in said rod line and including a second nut threading onto said second threaded end to bear against said second bearing surface, and means rigidly joining said first and second bearing plate means, whereby tightening of said nuts tightens said rod line.

18. A rod tie system as recited in claim 9 and further comprising means forming a third articulating bracket articulatable in at least one plane and adapted for use in attaching an end opposite said one end of said rod line to a second wall opposite said first wall.

19. A rod tie system as recited in claim 10 and further comprising means forming a third articulating bracket articulatable in at least one plane and adapted for use in attaching an end opposite said one end of said rod line to a second wall opposite said first wall.

* * * * *